United States Patent [19]

Florentino

[11] Patent Number: 4,541,542

[45] Date of Patent: Sep. 17, 1985

[54] PAINT TRAY COVER

[76] Inventor: Gregory Florentino, 130 Third Ave., Brentwood, N.Y. 11717

[21] Appl. No.: 588,396

[22] Filed: Mar. 12, 1984

[51] Int. Cl.[4] ..... B65D 41/16; B65D 41/18

[52] U.S. Cl. ..... 220/306; 206/361; 206/15.2; 401/118; 401/126

[58] Field of Search ..... 220/306; 206/15.2, 361; 401/118, 126

[56] References Cited

U.S. PATENT DOCUMENTS 3,406,812 10/1968 Henry ..... 401/118

3,620,403 11/1971 Rump ..... 220/306

4,342,403 8/1982 Badtke et al. ..... 220/306

4,359,161 11/1982 Sinoff ..... 206/461

*Primary Examiner*—George T. Hall

*Attorney, Agent, or Firm*—Alfred Walker

[57] ABSTRACT

An improved paint tray cover for a paint tray including a generally rectangular surface extending over the four (4) sides of the paint tray. The surface has a wedge-shaped and longitudinal spatial protrusion preformed along a center line of the surface to accommodate the handle of a paint brush in the tray. The cover is designed to securely attach to the paint tray.

6 Claims, 11 Drawing Figures

PAINT TRAY COVER

BACKGROUND OF THE INVENTION

This invention relates to a cover for paint trays which are used with roller and other types of brushes for paint.

During extended painting of wall surfaces with a roller brush, the paint is commonly applied from a tray such as those shown in Touchett in U.S. Pat. No. 2,694,825 and Vines in U.S. Pat. No. 3,729,764. Typically the painter must expend a considerable amount of time in applying the paint over a number of shifts of several hours each. If the time between shifts is extended, such as overnight, the paint must be delicately poured back into the original can and then the brush and tray are thereafter washed so that the brush and paint do not become dry and therefore unusable. Such cleaning operation normally takes a matter of time and for the typical homeowner involved in a number of household tasks, the repeated cleaning of the tray causes a time burden. The cleaning of the containers is simply inconvenient to carry out. The user often gets paint upon his or her hands in cleaning said tray and roller. Moreover the cleaned brush becomes unusable until time for it to dry has elapsed. If the tray and roller is left without cleaning, the brush may become brittle or tend to accumulate with coagulated paint, making smooth application of subsequent paint layers both inconvenient and untidy.

Paint tray disposable liners have been patented by Martin in U.S. Pat. No. 3,514,012, however these disposable liners are not economical because they require the painter to dispose of a considerable amount of paint which would otherwise be used. They also do not alleviate the necessity to clean the paint roller between uses.

SUMMARY OF INVENTION

The present invention has for its object to provide novel and useful cover for conventional paint trays for roller brushes which will cover the paint tray snugly enough to prevent the paint from drying out while also providing a preformed cavity to accommodate the handle of the roller brush. It is an object of the invention to provide a flexible cover which will prevent the paint from drying out between usings.

It is further an object of the invention to provide a cover of such design which will accommodate conventional paint roller brush handles so that said roller brush can be retained within the paint between usings, thereby obviating the necessity of cleaning said tray and roller brush between application of paint.

According to the invention, a cover is provided which is disposed to fit over the edges of conventional paint trays snugly, either by folded edges or by snap-like clips. The paint tray cover has a protrusion or cavity formed in its surface which acts as a spatial device to accommodate the paint roller brush handle.

DESCRIPTION OF THE PREFERRED EMBODIMENTS

Figure 1:
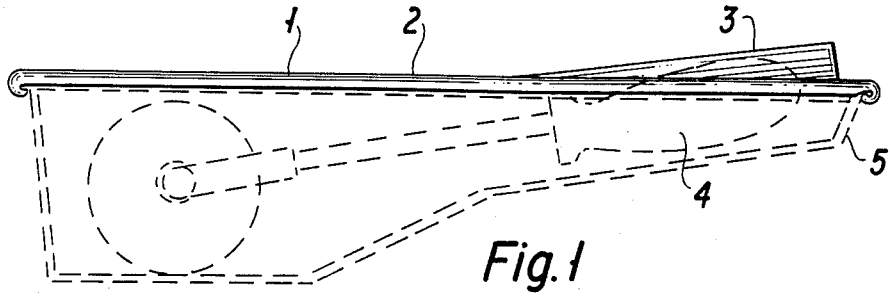
FIG. 1 is a side view of one embodiment of the device showing the paint tray cover over a conventional paint tray.
Figure 2:
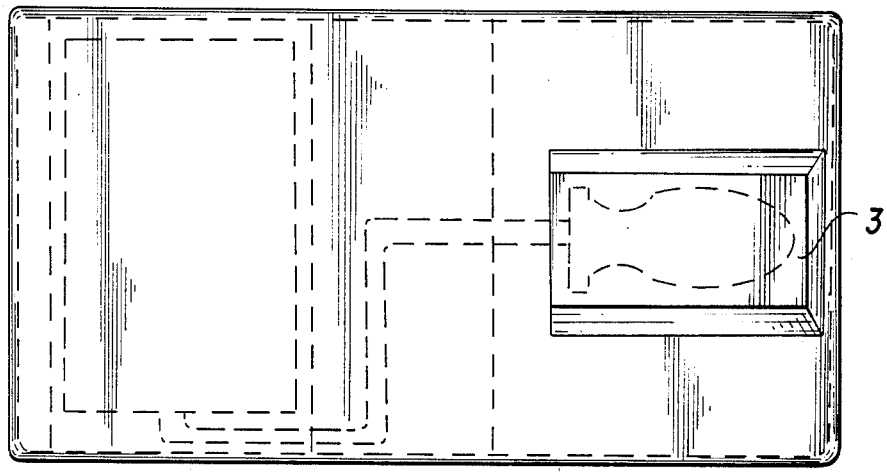
FIG. 2 is a top view of said paint tray cover as shown in FIG. 1.
Figure 3:
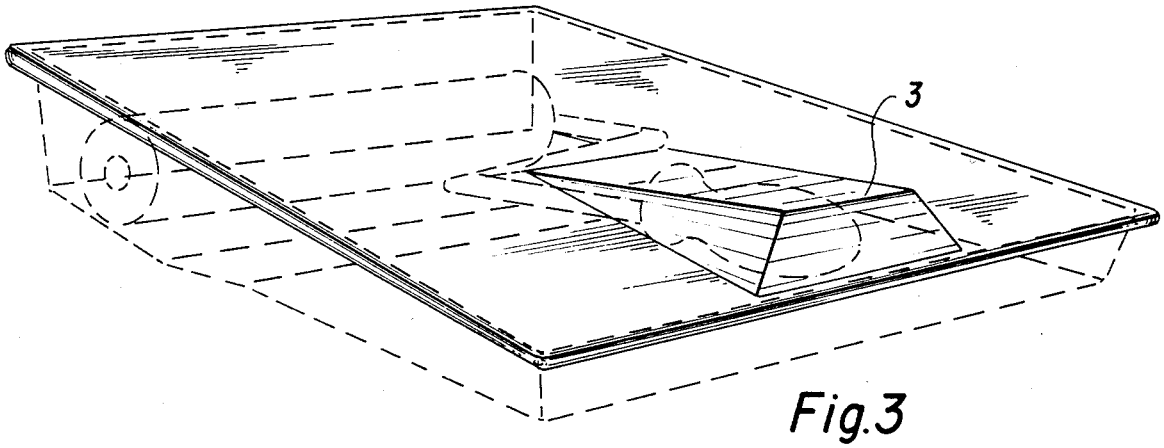
FIG. 3 is a perspective view of said paint tray cover shown in FIG. 1.
Figure 4:
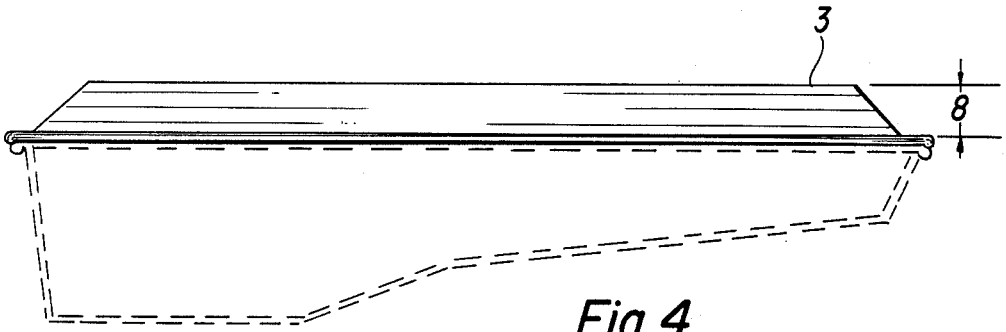
FIG. 4 is a side view of a second embodiment of the invention.
Figure 5:
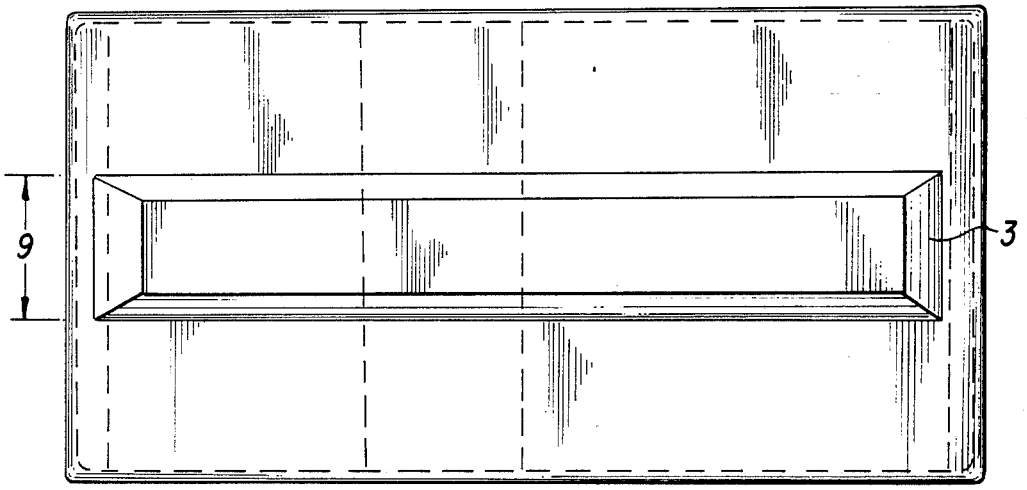
FIG. 5 is a top view of the embodiment as shown in FIG. 4.
Figure 6:
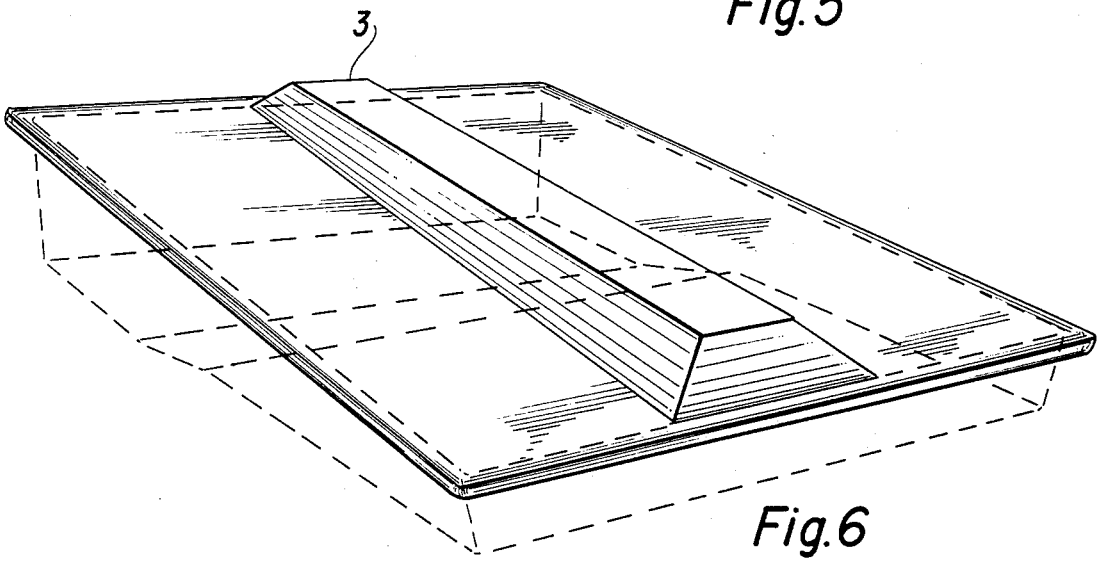
FIG. 6 is a perspective view of the embodiment as shown in FIG. 4.
Figure 7:
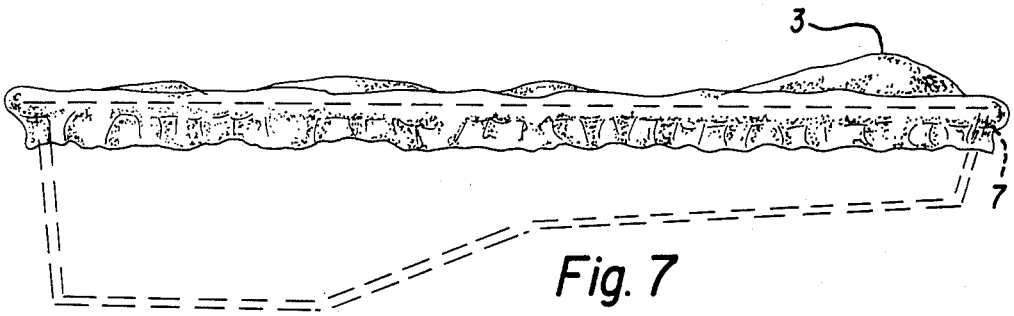
FIG. 7 is a side view of a third embodiment of the invention comprising a flexible material with an elastic-type boundary.
Figure 8:
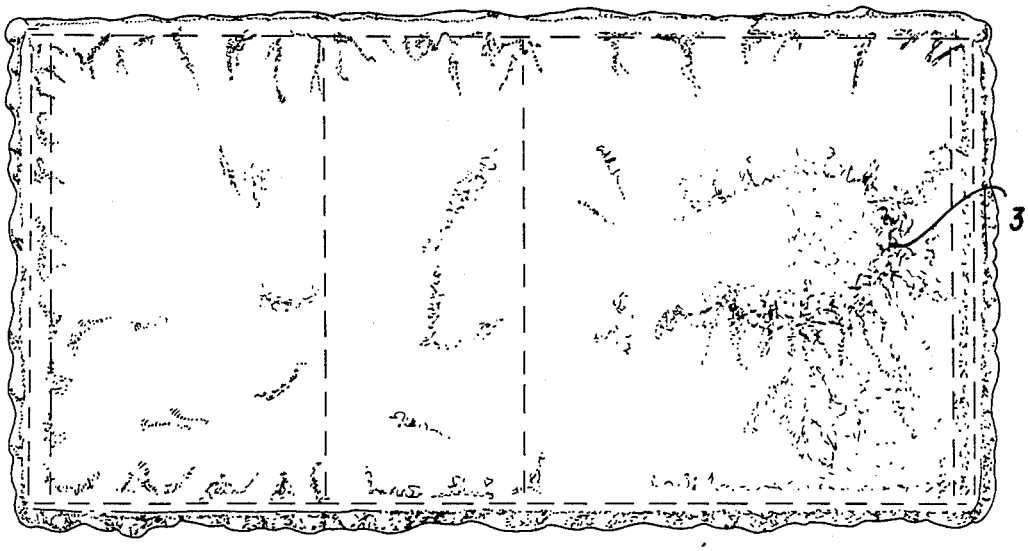
FIG. 8 is a top view of the embodiment as shown in FIG. 7.
Figure 9:
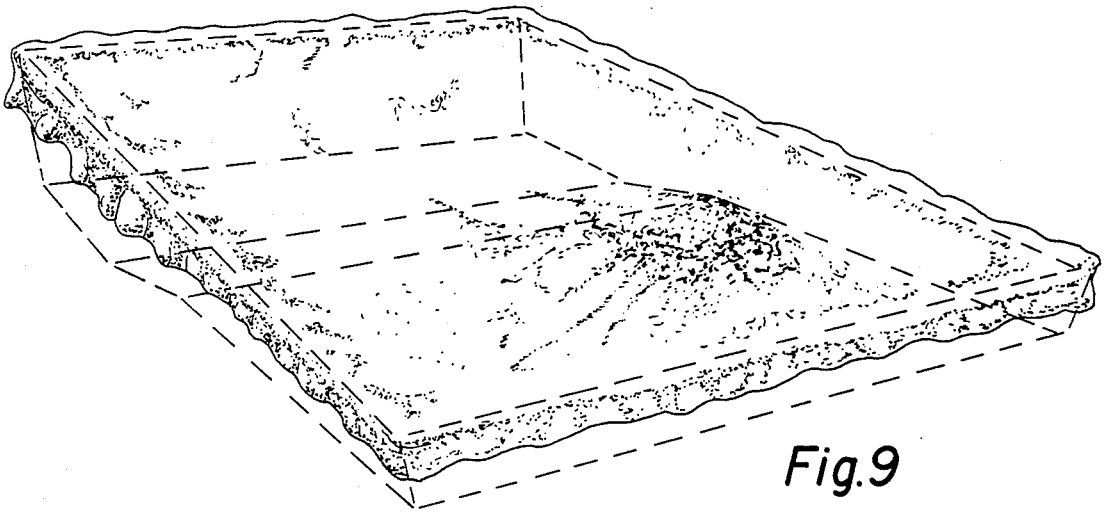
FIG. 9 is a perspective view of the embodiment as shown in FIG. 7.

Referring to FIG. 1, paint tray cover 1 contains a surface 2 containing a spatial protrusion 3 to accommodate a paint roller brush handle. Said cover 1 is made of a flexible semi-rigid material, such a polyethylene, which will be flexible to allow a snug airtight fit over a conventional paint tray 5. Said cover has said spatial protrusion 3 preformed therein as a wedge-shaped cavity.

In a second embodiment, the spatial protrusion 3 extends the entire length of the paint tray cover 1. In a third embodiment as shown in 7, 8 and 9, said paint tray cover comprises a flexible material softer than the polyethylene in FIGS. 1–6. Around the circumference of said cover 1 there is provided a loop or lining within which an elastic band 7 may be wrapped securely around the edges of the paint tray 5. Said flexible material has preformed therein a spatial protrusion bulging up from the surface of said paint tray cover 1. The protrusion has a height 8 and a width 9 large enough to accommodate the extension of the paint brush handle above the surface of the paint tray cover.

Figure 10:
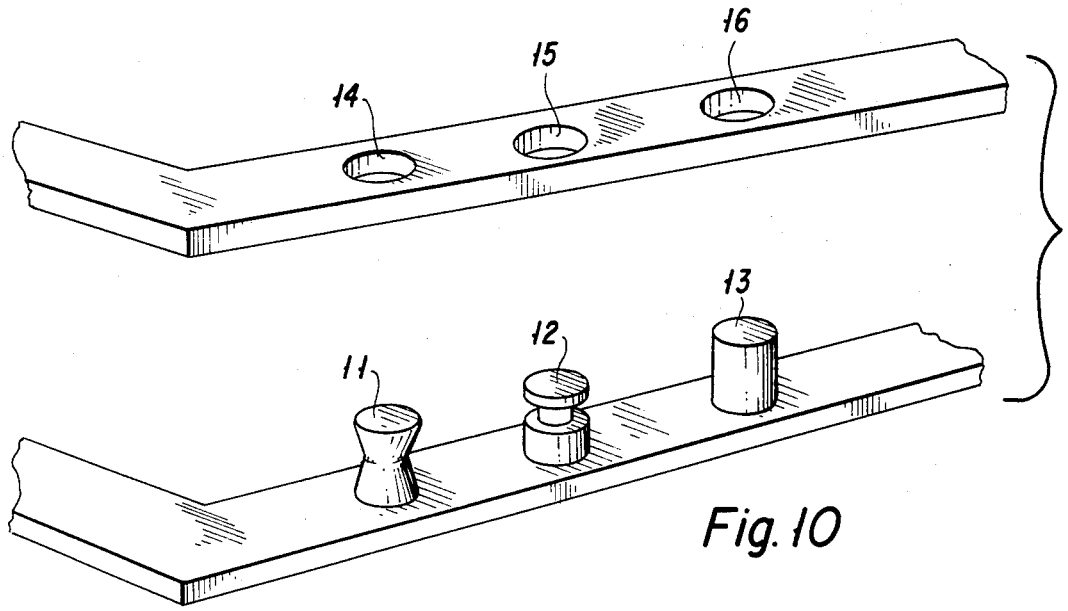
FIG. 10 is a perspective view of several clip-type devices located upon a paint tray cover or upon a paint tray which are attached by the use of holes disposed upon the respective paint tray and paint tray cover.

A further embodiment of the invention as shown in FIG. 10 may include as edge fasteners several clip-type devices 11, 12 or 13, which are shaped so as to allow said clip-type devices 11, 12, or 13 to snap into corresponding holes 14, 15 or 16. Said clip-type devices may be built into the paint tray 5 with the holes on the cover 1 or may be built into the cover 1 and the holes built into paint cover 5.

Figure 11:
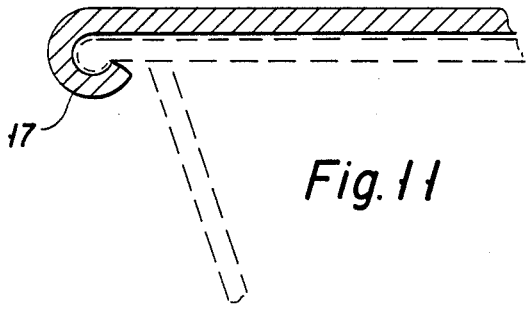
FIG. 11 is a side view close-up showing how the paint tray cover is attached to the paint tray.

FIG. 11 shows another type of fastener 17 for the paint tray cover comprising a curved clip 17 on the edges of the said paint tray cover 5 which snap fits said paint tray cover.

I claim:

1. A paint tray cover for a paint tray comprising: A generally rectangular surface extending over the four sides of the paint tray, said surface having a wedge shaped spatial protrusion preformed along a center line of said surface to accommodate the handle of a paint brush in said tray, and means for securely attaching said paint tray cover airtight relation to said paint tray.

2. The invention in claim 1 wherein said paint tray cover is attached to said paint tray by a plurality of clip-type devices in either one of said tray or said surface and corresponding holes on the other of said tray or surface.

3. The invention as in claim 1 wherein said paint tray cover is attached to said paint tray generally by a snap-fitting edge fastened securely over the sides of said paint tray.

4. A paint tray cover for a paint tray comprising: A generally rectangular surface extending over the four sides of the paint tray, said surface having a longitudinal protrusion extending the length of the paint tray cover spatial protrusion preformed along a center line of said surface to accommodate the handle of a paint brush in said tray, and means for securely attaching said paint tray cover in airtight relation to said paint tray.

5. The invention as recited in claim 1 wherein the wedge shaped protrusion comprises a three dimensional body having a flat top transverse from the surface of the paint tray cover to a point having a height at least as large as the height of a paint roller brush handle above the inner surface of the said paint tray.

6. The invention as in claim 4 wherein the spatial protrusion comprising a three dimensional, trapezoidal shaped longitudinal protrusion having a height at least as large as the height of a paint roller brush handle above the inner surface of the said paint tray.

* * * * *